US005441147A

United States Patent [19]

Tanner

[11] Patent Number: 5,441,147

[45] Date of Patent: Aug. 15, 1995

[54] PLASTIC PACKAGING COLLARS FOR DRINK CANS

[76] Inventor: Bernard Tanner, Box 42043, Acadian P.O., Calgary, Alberta, Canada, T2J 7A6

[21] Appl. No.: 251,684

[22] Filed: May 31, 1994

[51] Int. Cl.[6] ..... B65D 71/00

[52] U.S. Cl. ..... 206/150; 294/87.2

[58] Field of Search ..... 206/147, 150, 151, 158, 206/427, 428; 294/87.2

[56] References Cited

U.S. PATENT DOCUMENTS

| | | | |
|---|---|---|---|
| 4,513,860 | 4/1985 | Rhoads | 206/150 |
| 4,586,742 | 5/1986 | Lew | 206/150 |
| 4,919,260 | 4/1990 | Cunningham | 206/150 |
| 4,925,020 | 5/1990 | Gordon | 206/150 |
| 5,065,862 | 11/1991 | Mousseau | 206/150 |
| 5,193,673 | 3/1993 | Rathbone | 206/150 |
| 5,265,718 | 11/1993 | Marco | 206/150 |

*Primary Examiner*—Jimmy G. Foster

*Attorney, Agent, or Firm*—Adrian D. Battison; Stanley G. Ade; Murray E. Thrift

[57] ABSTRACT

A conventional plastic packaging member of the type including a plurality of collars for engaging around the upper flange of a drink can to hold the cans together as a group for transportation is modified in that it is formed from two or more layers of plastics material which are bonded together with a degradable adhesive. Each layer is cut through at a particular location around the collar with the cut lines of one layer being offset from the cut lines of the other layer so that each cutline is bridged by a continuos portion of the layer. On breakdown of the degradable adhesive the packaging member falls into the two separate layers which are thus cut through by the cut lines to prevent the collars or loops in the layer from engaging around livestock with the danger of entrapment.

7 Claims, 2 Drawing Sheets

PLASTIC PACKAGING COLLARS FOR DRINK CANS

BACKGROUND OF THE INVENTION

This invention relates to a plastic packaging member of the type for connecting a plurality of drink cans into a group for simultaneous transportation.

It is well known that drink cans are supplied in groups connected simply by formed plastic members defining a plurality of collars so that each collar engages around a top rim of a respective one of the cans as a frictional fit with sufficient elasticity to hold the collar in place at the upper rim of the can, The collars are then interconnected by suitable connecting strips formed integrally on the body so that, for example, six such cans are held together in a group by the plastic packaging member These plastic packaging members are sold in millions to accompany the millions of drink cans of soft drink and beer distributed widely throughout the world.

It is well known that one problem with such plastic packaging members is that they act as a trap for fish, marine animals or land animals which can place the head or a leg through the holes in the packaging member and then become trapped leading to suffocation or starvation. While many people dispose of the packaging member responsibly, the huge number of such packaging members used means that some become released into the environment inadvertently and therefore can cause harm to the livestock as stated above.

SUMMARY OF THE INVENTION

It is one object of the present invention, therefore to provide an improved plastic packaging member of this type which avoids or reduces the possibility of an animal or fish becoming trapped in the collars.

According to one aspect of the invention there is provided a plastic packaging member for connecting a plurality of drink cans comprising a flexible plastic body defining a plurality of annular collars each for engaging around an upper rim of a respective one of the plurality of drink cans, each collar having a thickness less than the width thereof and means interconnecting the collars to hold the plurality of cans interconnected for carrying as a group, the body being formed a plurality of layers at least partly overlapping such that the thickness of the collars at least part thereof is formed by the overlapped layers, each layer having in at least one collar at least one cut through the thickness and width thereof with the cut of one layer being spaced around the collar relative to the cut of another layer, and degradable adhesive means interconnecting the layers such that on degradation of the adhesive means the layers separate such that said at least one collar in each layer is opened by the respective cut therein.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
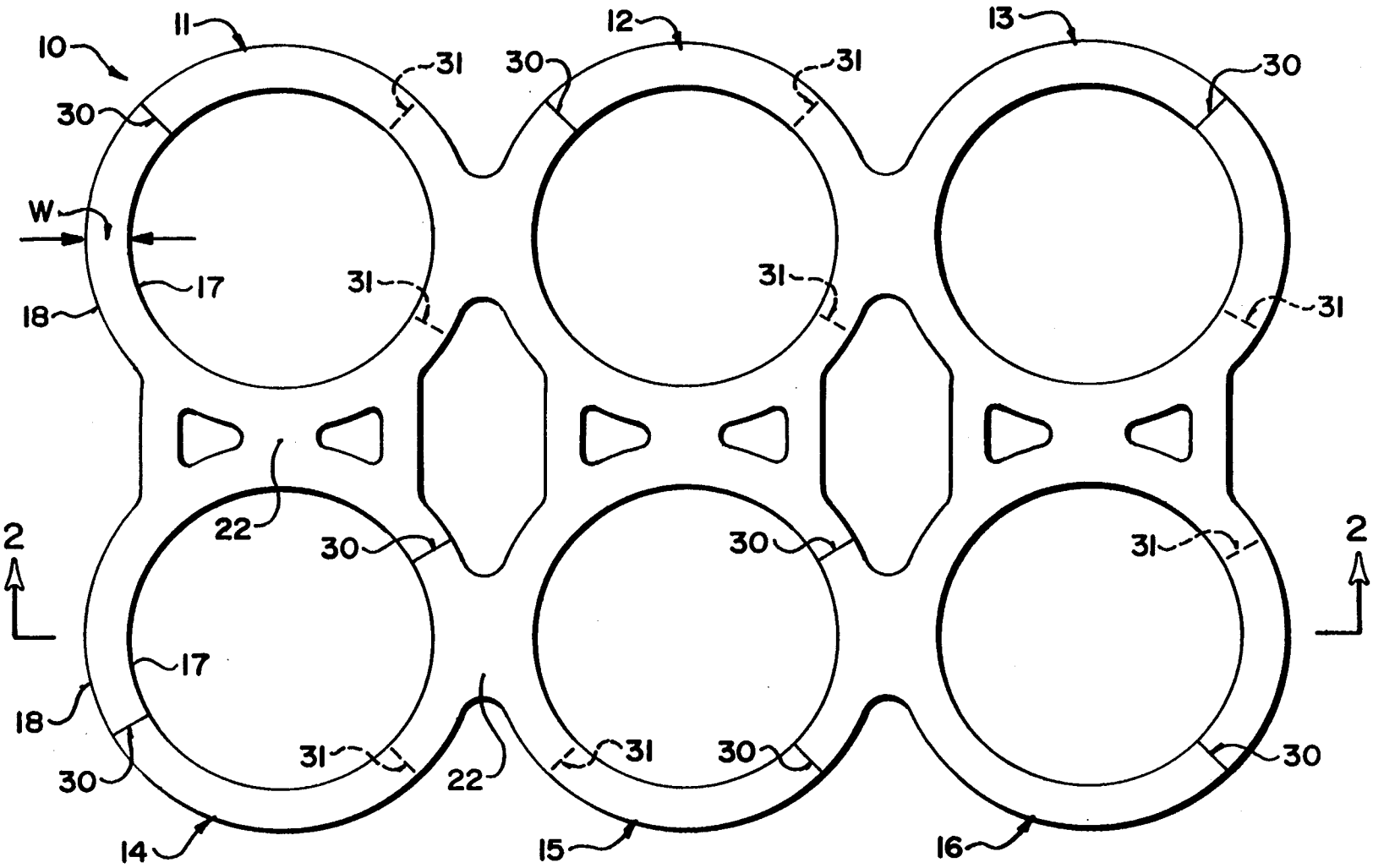
FIG. 1 is a top plan view of a plastic packaging member according to the present invention.
Figure 2:
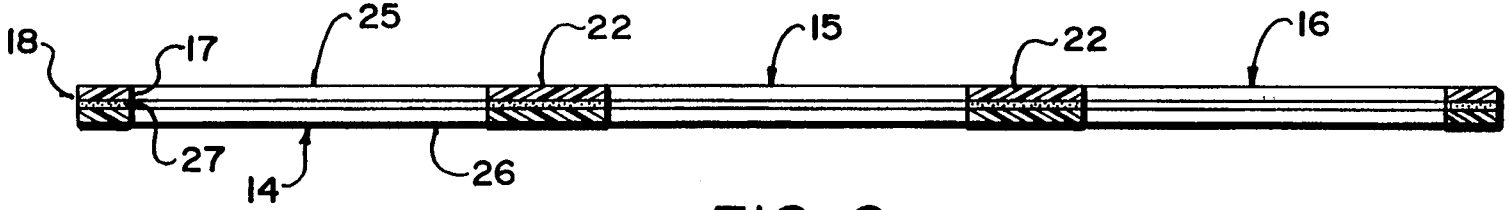
FIG. 2 is a cross sectional view along the lines 2—2 of FIG. 1.
Figure 3:
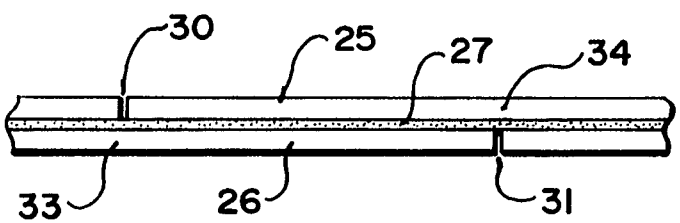
FIG. 3 is a cross sectional view through a part only of the packaging member of FIG. 1 showing the offset cuts in the first and second layers.
Figure 5:
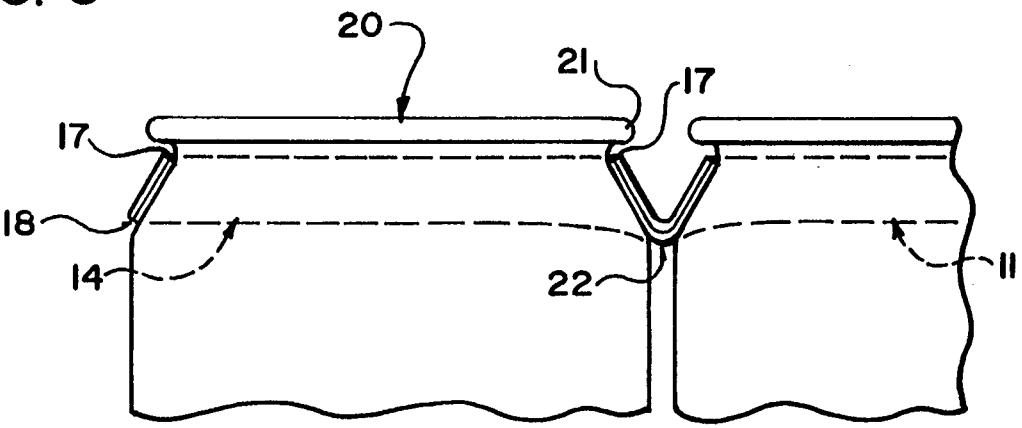
FIG. 5 is a cross sectional view showing for completeness the mounting of the packaging member of FIG. 1 on a plurality of cans.

The plastic packaging member shown in FIGS. 1 and 2 is generally of conventional shape and comprises a body 10 defined by 6 collars 11, 12, 13, 14, 15 and 16. Each collar has an inner circular edge 17 and an outer circular edge 18 defining a width W therebetween. Each collar is thus substantially annular. The collars are dimensioned so that as shown in FIG. 5 the collar can sit at the top of the can indicated at 20 so that the inner edge 17 of the collar engages up under a top flange 21 of the can with the outer edge 18 of the collar extending downwardly and outwardly of the can so that the collar is held as a friction fit on the can with a slight elasticity of the collar holding the collar in place on the can.

The collars are interconnected by strips or integral connecting elements 22 the shape and arrangement of which vary depending upon the particular style of packaging member used. It's suffice to say that the collars are interconnected to form a group of the collars by the connecting portions 22.

The conventional packaging member described above is modified by the construction of the present invention in that the plastic packaging member is formed in two layers 25 and 26. In the embodiment shown the layers 25 and 26 are coextensive and each of the collars is defined by an annular portion of each of the layers. For this reason the layers can be formed of thinner material than is conventionally used. The layers are bonded together by an adhesive material 27 which again is coextensive with all of the overlapping areas of the two layers so that the layers are effectively united or integrated by the adhesive layer therebetween.

Each of the layers is cut at a plurality of separate locations around the collars so that a cut line 30 in the layer 25 extends through the thickness and width of the layer 25. Similarly a cut line 31 in the layer 26 extends through the width and thickness of the layer 26. For convenience of illustration the cut lines 30 in the layer 25 are shown in FIG. 1 in full line while the cut lines 31 in the layer 26 are shown in dotted line.

The cut lines 30 and 31 are arranged so that they do not overlap that is they are arranged at separate positions on the periphery of each of the collars. Thus when the layers are integrated by the adhesive, the cut lines 30 are bridged by a continuous portion 33 of the layer 26 and similarly the cut lines 31 in the layer 26 are bridged by continuous portions 34 in the layer 25. The complete integral packaging member is therefore continuous in that it forms continuous collars without the cut lines being readily apparent to the user.

The adhesive 27 is formed of a degradable material which can degrade, for example, under the presence of moisture or can degrade under the presence of ultra violet light or both. The degradation of the adhesive can be effected relatively rapidly in comparison, for example with the degradation of conventional biodegradable plastics materials.

Figure 4:
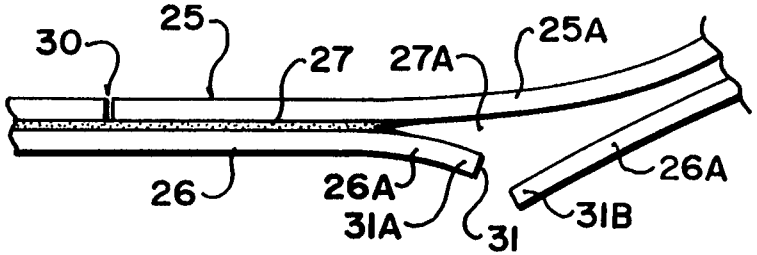
FIG. 4 is a cross sectional view similar to that of FIG. 3 showing the separation of the layers subsequent to the degradation of the adhesive.

As shown in FIG. 4 when the layer 27 degrades as illustrated at 27A, the layers 25 and 26 separate to form separate portions 25A and 26A. When the degradation reaches a cut line 31, this allows the layer 26 to separate at the cut line 31 to form two separate portions 31A and 31B.

By comparing the locations of the cut lines in FIG. 1, it will be noted that each collar has for each layer a cut line so that when the degradation has occurred, the two separate layers have collars which are separated or broken so that there is no complete collar to surround and engage an animal or fish. All the large loops are therefore open in both the upper and lower layers.

In an alternative arrangement (not shown) one of the layers may not be continuos over the full extent of the collars so that for example the second layer may be only be provided at the bridging areas 33 necessary to bridge the cut lines 30. In addition, in a further alternative, The number of cut lines may be significantly increased so that the layers each break into a number of separate pieces none of which forms a continuous loop so there is no possibility of engaging around an animal or the like.

A type of plastics material used for the layers can be selected in accordance with well known principles to provide a material which is sufficiently strong to allow the transportation of the cans in a group with sufficient elasticity to hold the collars in place on the cans. The adhesive can also be selected from a number of well known adhesives which allow degradation under various environmental action such as moisture and ultra violet light. The time period under which degradation occurs can be varied by selection of the type of adhesive to ensure that, when the packaging members are used in an area of increased environmental activity, they do not break down prematurely.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A plastic packaging member for connecting a plurality of drink cans comprising a flexible plastic body defining a plurality of annular collars each for engaging around an upper rim of a respective one of the plurality of drink cans, each collar having a thickness less than the width thereof and means interconnecting the collars to hold the plurality of cans interconnected for carrying as a group, the body being formed a plurality of layers at least partly overlapping such that the thickness of the collars at least part thereof is formed by the overlapped layers, each layer having in at least one collar at least one cut through the thickness and width thereof with the cut of one layer being spaced around the collar relative to the cut of another layer, and degradable adhesive means interconnecting the layers such that on degradation of the adhesive means the layers separate such that said at least one collar in each layer is opened by the respective cut therein.

2. The packaging member according to claim 1 wherein each collar has at least one cut in each layer thereof.

3. The packaging member according to claim 1 wherein each layer defines at least a portion of each of the collars.

4. The packaging member according to claim 3 wherein each layer defines each of the collars.

5. The packaging member according to claim 4 wherein the layers are substantially coextensive.

6. The packaging member according to claim 1 wherein there are only two separate layers.

7. The packaging member according to claim 1 wherein the adhesive means is located between the layers at all positions thereon which overlap.

* * * * *